United States Patent [19]

Motyka et al.

[11] 4,084,676

[45] Apr. 18, 1978

[54] TOKEN OPERATED ICE DISPENSER

[75] Inventors: Jerry J. Motyka, Detroit; Donald J. Lewis, Troy, both of Mich.

[73] Assignee: Lamar Tobias, Sturgis, Mich.

[21] Appl. No.: 697,778

[22] Filed: Jun. 21, 1976

[51] Int. Cl.[2] ..... G07F 13/00

[52] U.S. Cl. ..... 194/87; 194/3; 222/367; 222/556

[58] Field of Search ..... 194/3, 83–90, 194/53, 66, 60, 61; 222/556, 2, 425, 450–452, 448, 449, 220, 368, 345, 424, 367, 225, 146

[56] References Cited

U.S. PATENT DOCUMENTS

| | | | |
|---|---|---|---|
| 906,075 | 12/1908 | Smith | 194/87 |
| 1,056,509 | 3/1913 | Daniels | 194/85 |
| 1,369,740 | 2/1921 | Gibbons | 222/452 |
| 1,912,134 | 5/1933 | Hanchett | 194/85 |
| 2,006,100 | 6/1935 | Hight et al. | 194/85 |
| 2,073,700 | 3/1937 | Keilholtz | 194/61 |
| 2,569,257 | 9/1951 | Parker | 222/2 |

FOREIGN PATENT DOCUMENTS

| | | | |
|---|---|---|---|
| 106,911 | 6/1917 | United Kingdom | 194/87 |

*Primary Examiner*—Allen N. Knowles
*Attorney, Agent, or Firm*—Krass & Young

[57] ABSTRACT

A token operated dispenser of metered quantities of crushed or cubed ice comprising a housing, a cylindrical magazine in the housing and having access and discharge openings, a closure rotatable on a shaft to close one opening while clearing the other, and a token-responsive clutch mechanism for controlling rotation of the closure. The clutch comprises two adjacent, coaxial members complementally forming a coin pocket such that a coin in the pocket mechanically couples the two members for common rotation. A cam ejects the token.

9 Claims, 7 Drawing Figures

TOKEN OPERATED ICE DISPENSER

INTRODUCTION

This invention relates to dispensers for ice and other particulate and fluid materials, and more particularly to a device which is operable only upon receipt of coins or tokens of pre-selected size to dispense a metered quantity of ice or other material.

BACKGROUND OF THE INVENTION

Ice is commonly made available in hotels, motels, marinas, trailer parks, camps, and other public or semi-public places by way of a machine which serves as both the ice maker and a bulk storage facility. The conventional ice machine is characterized by a large insulated storage compartment having an access door which permits individuals desiring ice to simply open the door and remove the desired quantity.

One problem which is posed by the conventional ice machine is the indiscriminate and unconservative removal of ice such that an equitable distribution of the available ice is not achieved. Another problem associated with conventional ice machines is one of sanitation; i.e., there is little or no control over the introduction of contaminants into the ice by diseased persons, animals, vandals and other sources.

Accordingly, a substantial advantage can be achieved by means of an instrumentality for dispensing metered quantities of ice at a predetermined price, or, when desired, through the use of tokens, the issuance of which is subject to appropriate supervision.

BRIEF DESCRIPTION OF THE INVENTION

The present invention provides an instrumentality through which ice or other coarse particulate materials may be dispensed in metered quantities through appropriate use of a coin or token to operate a dispenser mechanism thus to regulate the distribution and use rate of the available ice, as well as to isolate the stored ice from the outside world.

In general, this is accomplished by means of a dispenser mechanism which may be mounted on an ice storage container and having a metering magazine which may be automatically loaded with ice in various ways together with coin or token operated means for controlling the position of a closure member mounted on the magazine. By operating the closure member against a bias device such as a spring, a meterd quantity of ice is dispensed after which the closure is automatically returned to the original position to prepare the magazine for additional loading.

In the preferred form the magazine member is cylindrical and has first and second angularly or circumferentially spaced openings formed therein, the first opening being positioned to receive ice in the normal loading process, and the second opening being positioned to drop ice from the magazine into a portable container or bucket whenever a closure member is rotated away from a position which normally seals off the second opening.

According to another feature of the invention, a coin-responsive clutch mechanism operates to permit only those having coins of predetermined physical characteristics to acquire ice, and then only in metered quantities. In the preferred embodiment, hereinafter described in greater detail, the coin or token operated clutch mechanism comprises first and second clutch members disposed in coaxial and closely adjacent positions. The clutch members have, on their adjacent faces, complemental and registering recesses which together form a coin pocket capable of receiving only coins of predetermined size; i.e., diameter and thickness. When a coin of the proper size and shape is placed between the two clutch members, the coin itself acts as a mechanical coupling between the members. Thus a manual control member or knob may be attached to one of the clutch members and the closure member attached to the other clutch member such that the closure may be rotated away from the sealing position only when a coin of the proper size is placed between the two clutch members.

A still further feature of the preferred embodiment hereinafter described is a coin pocket between the clutch members which is continuous such that coins or tokens of less than the proper size will fall through without affecting the mechanical coupling. A still further feature is the provision of a cam member operating in connection with the clutch assembly to automatically eject coins from the clutch pocket after a predetermined angular rotation has been accomplished. Typically, this angular rotation corresponds with that necessary to dispense a certain quantity of ice from the magazine. For purposes of description, the invention is embodied in a dispenser for ice; however, it is to be understood that a similar mechanism embodying the invention may also be used to dispense other materials including fluids. Also for definitional purposes, the term "coin" will be used hereinafter to denote both minted pieces of pre-assigned monetary value and tokens or slugs having no significant value aside from use in the dispenser mechanism hereinafter described.

DETAILED DESCRIPTION OF THE SPECIFIC EMBODIMENT

Figure 1:
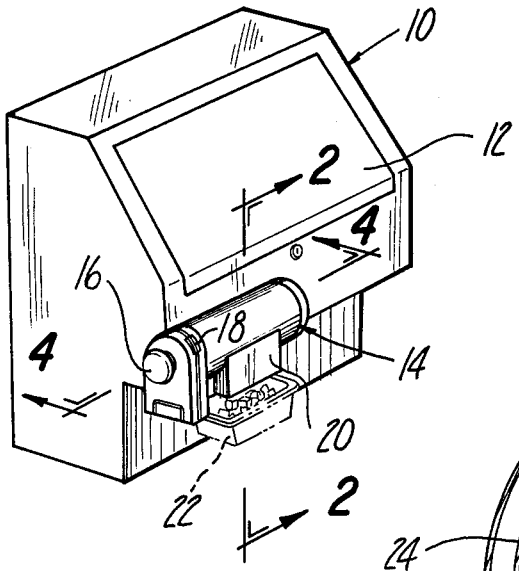
FIG. 1 is a perspective view of an ice dispenser embodying the invention mounted on a conventional ice machine.

Looking to FIG. 1, a conventional ice machine 10 having an ice maker (not shown) and an insulated storage bin with a locked access door 12 is provided with a front mounted dispenser housing 14 constructed in accordance with the invention for dispensing metered quantities of ice upon rotation of a manual control knob 16. Knob 16 actuates the dispensing mechanism only if a coin of appropriate size is first placed in a coin slot 18. The metered quantity of ice is dispensed through a chute 20 into a hand-held container such as the tray 22.

As best shown in FIGS. 2 through 4 and 7, the ice dispenser comprises an insulated housing 14 of substantially semi-cylindrical configuration adapted to mount on the front of the ice machine 10 such that the internal mechanism thereof projects into the ice storage area whereby loading of the dispenser is accomplished automatically as ice is produced. Various other automatic loading mechanisms such as rakes, conveyors and agitators may, of course, be employed.

The dispensing mechanism comprises a magazine member comprised of a cylindrical magazine 24 disposed within housing 14 so as to project into the ice storage area. Magazine 24 is provided with a first input opening 26 which registers with the access into the ice storage area such that ice may be loaded into the magazine in one of various ways. Magazine 24 has formed therein a second circumferentially spaced discharge opening 28 which registers with the chute 20 such that a metered quantity of ice may be dispensed by force of gravity therethrough. The mechanism further comprises a closure means including member 30 which is mounted and rotatable with a shaft 32 extending coaxially through the housing 14 and magazine 24. In the normal or rest position, closure member 30 seals off the discharge opening 28 to prevent the dispensing of ice. Closure 30 is preferably insulated to prevent any melting in the magazine 24. Shaft 32 is rotatable along with closure 30, as hereinafter described, to a second position illustrated in FIG. 3, wherein the discharge opening 28 is fully opened or cleared to dispense ice and the input opening 26 is partially or fully closed to prevent any additional ice from entering the magazine 24. After the closure 30 has been fully rotated to the discharge position, it is returned automatically, by an instrumentality to be described, to the closed position.

Figure 4:
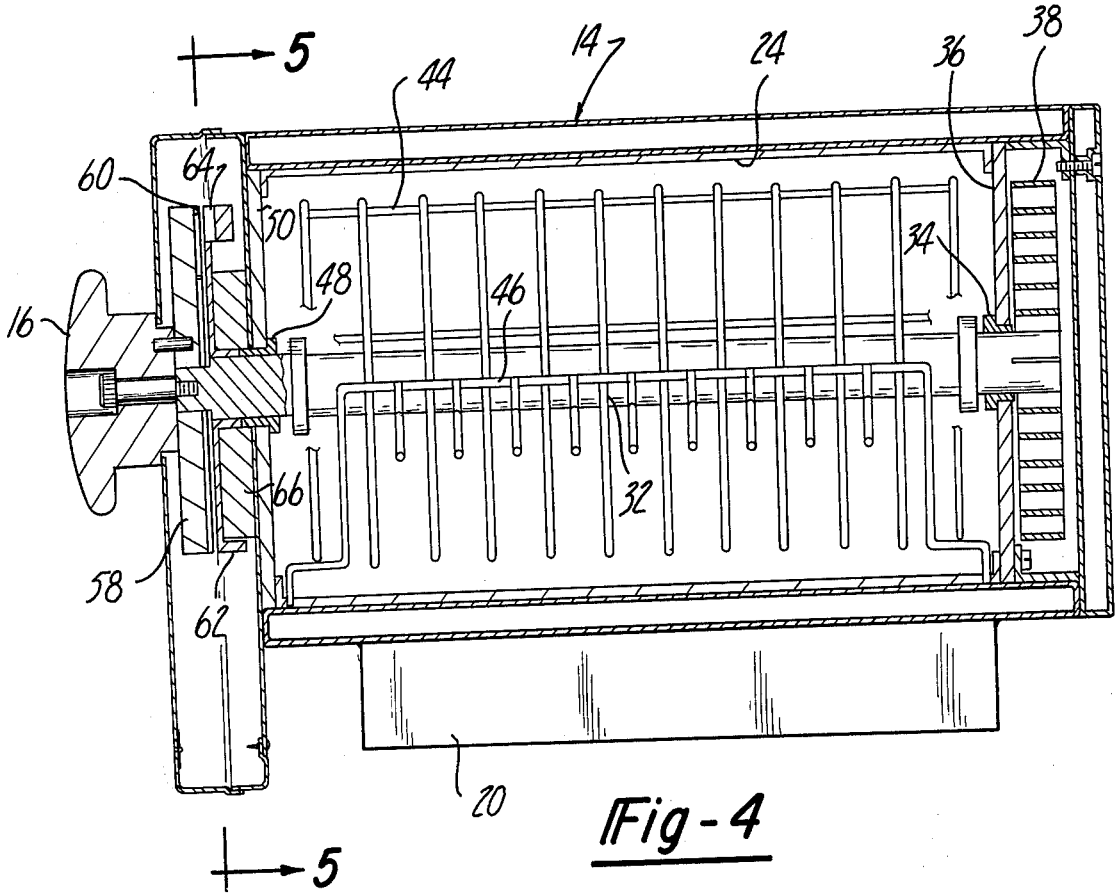
FIG. 4 is a front view partly in section of the dispenser mechanism of FIGS. 2 and 3.
Figure 7:
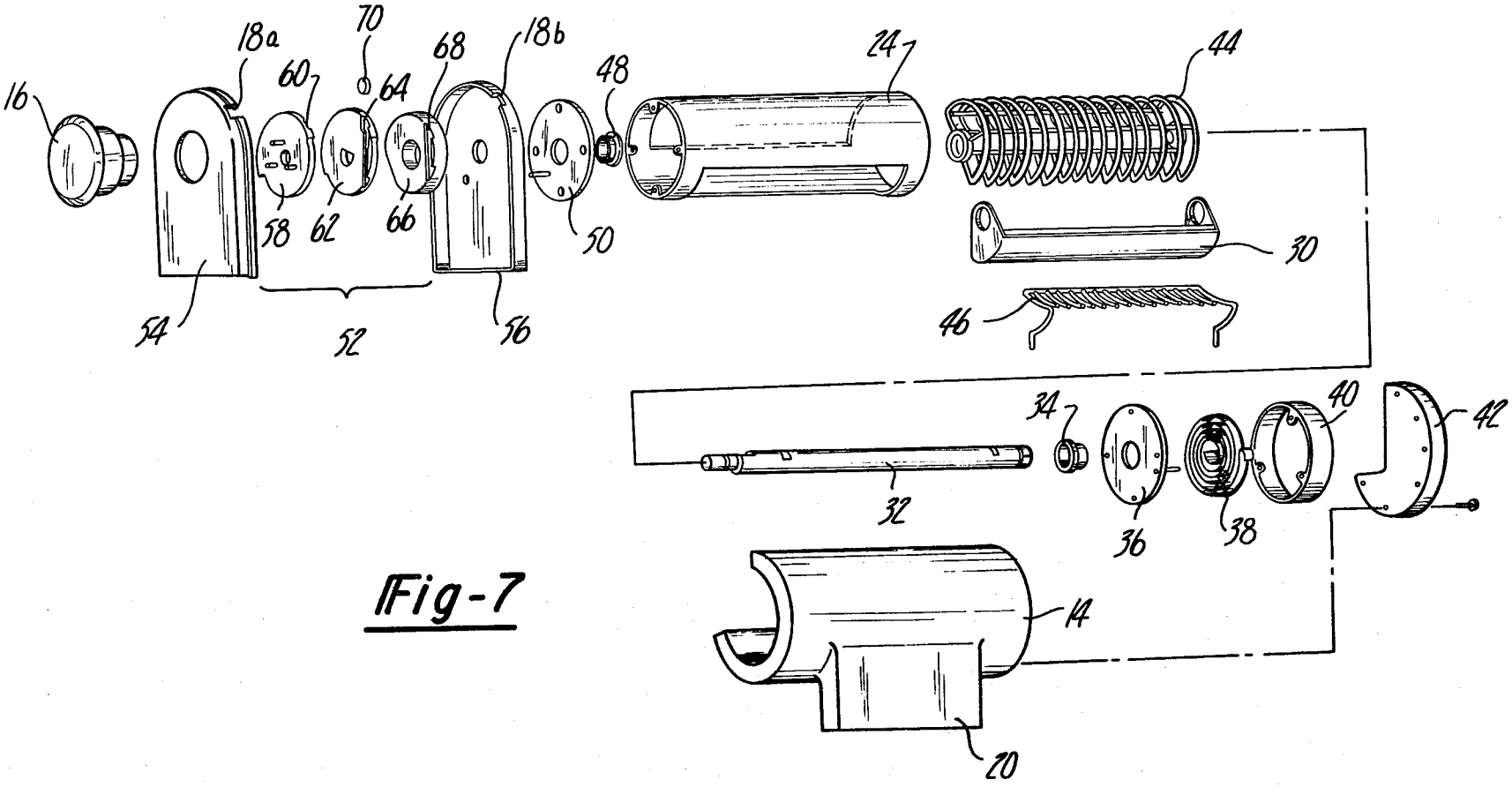
FIG. 7 is an exploded perspective view of the dispenser mechanism of FIGS. 1 through 6 showing the more significant components thereof.

To accomplish the automatic return, bias means is included, in which shaft 32 is rotatably secured at the right end as shown in FIGS. 4 and 7 in a bushing 34 which passes into and through a plate 36 and at the left end by a bushing 48 and a fixed plate 50. Plate 36 acts as a stop for the outer end of a flat coiled spring 38. The inner end of spring 38 is secured to shaft 32 to bias the shaft and the closure member 30 to the closed position. As the shaft 32 and closure 30 are rotated together to the open position, the spring 38 is wound up to increase the bias force. Spring 38 is disposed within a ring 40 and closed off by end plate 42 which is secured by screws or other suitable fasteners to the end surface of housing 14.

Figure 2:
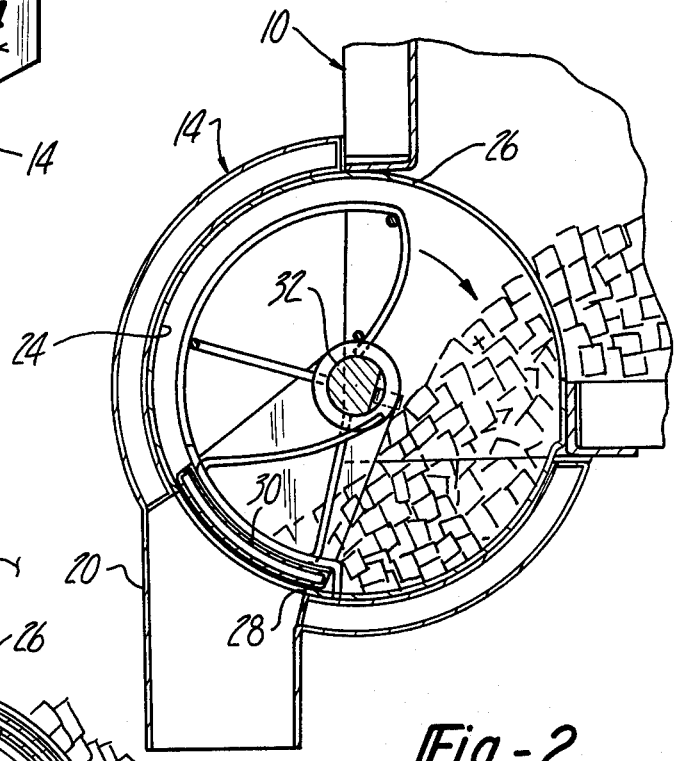
FIG. 2 is a side view partly in section through the ice dispenser mechanism in the loading position.
Figure 3:
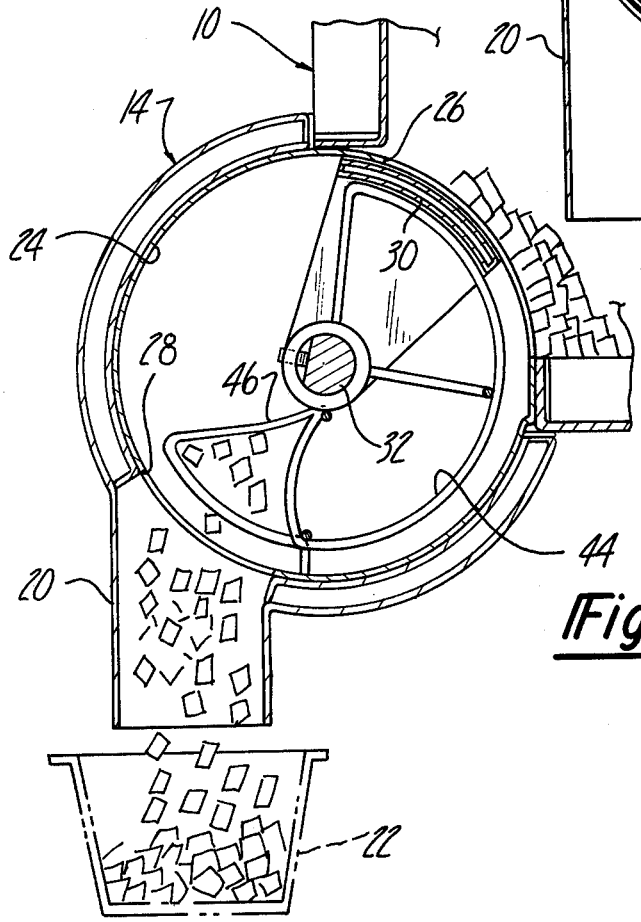
FIG. 3 is a side view partly in section of the dispenser mechanism in the dispensing position.

To assist in the gravitational discharge of ice from magazine 24, clearing means is provided including a clearing member comprised of an open wire basket 44 having plurality of parallel spaced semi-cylindrical rungs is mounted on shaft 32 for rotation therewith. A second clearing member is also provided comprised of a clearing bar 46 having a plurality of spaced fingers interleaving with the rungs of basket 44 is secured in a fixed position within the magazine 24 as best shown in FIGS. 2 and 3 to clear ice from the basket 44 as it is rotated with shaft 32 and closure 30.

Shaft 32 is seated at the left end thereof as shown in FIGS. 4 and 7 in bushing 48 which passes through and is secured by plate 50 which is held against rotation by being pinned through a fixed clutch assembly cover plate 46 as hereinafter described.

Selectively operable means is provided for rotating the closure 30 including the coin actuated control mechanism, which in turn includes clutch assembly 52 disposed within a enclosure formed by recessed shell-like stampings 54 and 56 mounted on the left end of the dispenser housing 14 as shown in FIGS. 1, 4 and 7. Clutch assembly 52 comprises a first disc-shaped clutch member 58 which is loosely mounted on shaft 32 for free rotation with respect to the shaft but is pinned securely to control knob 16 for rotation therewith. Clutch assembly 52 further comprises a second disc-shaped clutch member 62 mounted on shaft 32 and keyed to the shaft for rotation therewith to provide means drivingly connecting it to the closure 30. Clutch members 58 and 62, as best shown in FIG. 4, each have clutch faces which are coaxially and adjacently disposed on the shaft 32 with the adjoining faces thereof in close proximity but adapted for relative rotation unless and until a coin 70 of suitable size is utilized in the fashion hereinafter described.

Figure 5:
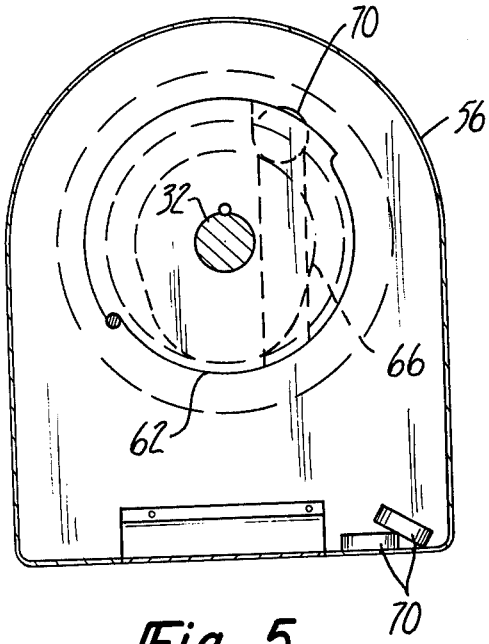
FIG. 5 is a sectional view through the clutch assembly in the device of FIG. 4.
Figure 6:
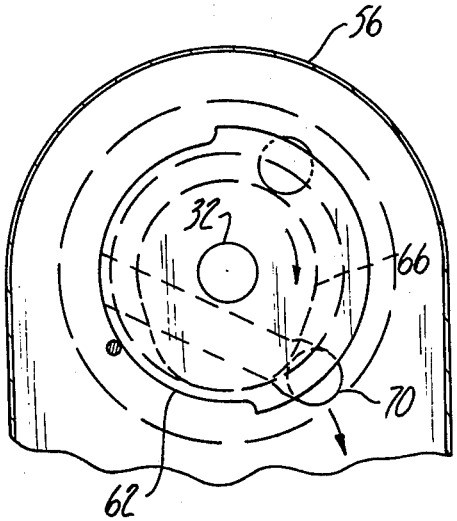
FIG. 6 is a sectional view through the clutch assembly but after rotation of approximately 100° from the position shown in FIG. 5.

The face of clutch member 58 which adjoins the face of clutch member 62 is cast or milled out to form a recess 60 opening to the periphery thereof and extending chordally across the face of the clutch member as illustrated by the dotted lines in FIGS. 5 and 6. Clutch member 62 is similarly cast or milled out to define a recess 64 which opens to the periphery thereof and then narrows down into a smaller chordal passage which extends across the entire face of the clutch member. When in registry recesses 60 and 64 form a chordally continuous slot which acts as a coin pocket which is adapted to receive and hold a coin 70 of appropriate diameter and thickness. Moreover, the axial depth of the coin pocket recesses together with the axial spacing between clutch members 58 and 62 is such that a coin 70 of adequate thickness establishes a mechanical interference coupling between clutch members 58 and 62 such that they rotate together as long as the coin is in the pocket. Accordingly, a torque which is manually applied to clutch member 58 by way of knob 16 is transferred through the coin 70 to clutch member 62 and thence to shaft 32 and the mechanical elements carried thereby.

The coin slot 18 formed in the stampings 54 and 56 together with the inherent dimensions of the coin pocket in cam members 58 and 62 operates to reject oversized coins. Undersized coins simply drop through the chordal slot and into the coin box illustrated in FIG. 5 without actuating the clutch assembly 52 as previously described. The preferred coin is a non-monetary token about the diameter of a nickel but substantially greater in thickness. Thus, quarters will be rejected as oversized and dimes, pennies and nickels will fall through the chordal passage. Accordingly, the distribution of the tokens can be carefully regulated by the owner or supervisory agency in charge of the ice machine 10.

Spring 38 biases clutch member 62 into a position wherein recess 64 registers with the coin slot 18. Knob 16 may be marked with suitable indicia to indicate the position in which coins will be accepted; i.e., the position in which recess 60 is in register with recess 64. A full turn comprises approximately 180° after which the coin 70 is forced out of the coin pocket into the coin box and spring 38 returns the closure 30 to the position illustrated in FIG. 2.

To urge coin 70 out of the coin pocket a cam member 66 is disposed loosely on shaft 32 and pinned to plate 50 so as to be fixed against rotation with shaft 32. Cam member 66, as best shown in FIG. 4, fits into the milled out or cast recess in the back of clutch member 52 such that coin 70, when in the coin pocket, bears against the peripheral surface of cam member 62 as best shown in FIG. 5. As the coin pocket is angularly displaced by rotation of clutch assembly 52, coin 70 rides along the periphery of cam 66 which, as shown in FIG. 6, increases radially until the coin 70 is pushed entirely from the coin pocket. This positive ejection of coin 70 is required by the fact that the coin, in providing the mechanical interference coupling between the clutch elements 58 and 62, is securely wedged in position and will not drop out automatically as long as a torque is applied to the knob 16.

OPERATION

Although the operation of the device is believed to be apparent from the foregoing description, a brief summary of operation will now be made. The user aligns knob 16 such that recess 60 registers with recess 64 and clutch members 58 and 62 respectively. A token or coin 70 is placed in the coin pocket and knob 16 is rotated in the clockwise direction. Clutch member 58 is mechanically coupled to clutch member 62 and shaft 32 by way of coin 70. Closure 30 is rotated away from the discharge opening 28. Basket 44 is rotated with shaft 32 through the fingers of clearing bar 46 and ice which is carried with the basket 44 is discharged through chute 20. At the full extent of travel coin 70 is urged out of the coin pocket by the peripheral surface of cam 66 and drops into the coin box shown in FIG. 5. The mechanical coupling between clutch members 58 and 62 is eliminated and bias spring 38 returns shaft 32 and door 30 to the closed position illustrated in FIG. 2.

It is to be understood that the ice dispenser of the subject invention may be manufactured for installation on a specific ice machine or may be installed in a retrofit fashion on existing ice machines after which the normal access door of the ice machine may be kept locked. Thus metered quantities of ice will be dispensed to persons who are authorized by possession of the coins 70 to receive ice. In addition, all direct access by users and other persons to the contents of the ice machine 10 will be eliminated and appropriate sanitation and purity will be assured. The components of the apparatus described above may be fabricated from any of various materials such as stainless steel and plastic. The foregoing description is illustrative in nature and is not to be construed in a limiting sense.

The embodiments of the invention in which an exclusive property or privilege is claimed are defined as follows:

1. A dispenser for delivering metered quantities of ice and like materials from a storage chamber comprising: a housing adapted to be mounted on a storage chamber, a magazine member mounted within the housing so as to project into the storage chamber and having a first opening position to permit access therein for material in said chamber and a second opening circumferentially spaced from the first opening to permit material in the magazine member to pass therethrough, closure means rotatably mounted relative to the magazine, bias means drivingly connected to said closure means urging the closure means to a position closing the second opening to prevent the material from passing through the second opening, and selectively operable means for rotating the closure means against the force of the bias means to open the second opening to permit material collected within the magazine to pass therethrough; and clearing means including a clearing member adapted to be rotated with said closure means to force material in said magazine through said second opening upon rotation of said closure means, said clearing member comprising a basket disposed on the shaft for rotation therewith and wherein said clearing means further includes a second clearing member nonrotatably mounted within the magazine adjacent the second opening for clearing ice from the basket.

2. Apparatus as defined in claim 1 wherein the selectively operable means comprises: a clutch assembly including first and second clutch members having clutch faces formed thereon and further including means mounting said clutch members coaxially and adjacently with respect to each other and having said clutch faces adjoining, a control member connected to the first clutch member for rotating same, means drivingly connecting the second clutch member to the closure means for rotation therewith, the adjoining faces of said clutch members having registering recesses formed therein to define a coin pocket of such size and shape as to receive a coin of preselected size and being of such axial spacing such that the coin forms a mechanical interference coupling between such clutch members whereby rotation of the control member causes rotation of the closure as long as the coin is in said pocket.

3. Apparatus as defined in claim 2 wherein said selectively operable means further include means for ejecting said coin from said pocket after the clutch members turn through a predetermined relative angle.

4. Apparatus as defined in claim 3 wherein the angle corresponds to the angular displacement between the first and second openings in the magazine member.

5. Apparatus as defined in claim 3 wherein said means for removing comprises a cam member fixed in position adjacent the clutch member and having a peripheral cam surface in contact with the coin during rotation of the second clutch member, said cam surface being shaped to eject said coin from said pocket.

6. Apparatus as defined in claim 2 wherein the first and second clutch members have formed in the adjoining faces thereof a chordally continuous coin slot contiguous with said pocket such that coins of less than the predetermined size fall directly through and between the adjoining faces of the clutch members without effecting said mechanical interference coupling.

7. Apparatus as defined in claim 2 further including a shaft rotatably mounted within the housing and within the magazine member, the closure means being mounted on the shaft for rotation therewith, the second clutch member being mounted on the shaft for rotation therewith, the first clutch member being loosely disposed over the shaft such that the control member and the first clutch member may be rotated independently of said shaft except when a coin forms a mechanical interference coupling as aforesaid.

8. Apparatus as defined in claim 1 wherein the magazine member is cylindrical in shape.

9. Apparatus as defined in claim 1 wherein the bias means is a flat coil spring.

* * * * *